US012577079B2

(12) United States Patent
Barnes et al.

(10) Patent No.: US 12,577,079 B2
(45) Date of Patent: Mar. 17, 2026

(54) DUAL ENDLESS BELT FLEXIBLE LANCE HOSE DRIVE APPARATUS AND SYSTEM

(71) Applicant: STONEAGE, INC., Durango, CO (US)

(72) Inventors: Jeffery R. Barnes, Ignacio, CO (US); Cooper Hanley, Durango, CO (US); John L. Krauser, Durango, CO (US); Daniel Szabo, Durango, CO (US)

(73) Assignee: StoneAge, Inc., Durango, CO (US)

( * ) Notice: Subject to any disclaimer, the term of this patent is extended or adjusted under 35 U.S.C. 154(b) by 761 days.

(21) Appl. No.: 17/871,808

(22) Filed: Jul. 22, 2022

(65) Prior Publication Data

US 2023/0021966 A1 Jan. 26, 2023

Related U.S. Application Data

(60) Provisional application No. 63/225,125, filed on Jul. 23, 2021.

(51) Int. Cl.

| | |
|---|---|
| ***B65H 51/10*** | (2006.01) |
| ***B65H 51/14*** | (2006.01) |
| ***F28G 1/16*** | (2006.01) |
| ***F28G 15/04*** | (2006.01) |

(52) U.S. Cl.

CPC ..... *B65H 51/105* (2013.01); *B65H 51/14* (2013.01); *F28G 1/163* (2013.01); *F28G 15/04* (2013.01); *B65H 2701/33* (2013.01)

(58) Field of Classification Search

None

See application file for complete search history.

(56) References Cited

U.S. PATENT DOCUMENTS

| | | | | |
|---|---|---|---|---|
| 3,468,409 | A | 9/1969 | Ball | |
| 9,896,299 | B2 | 2/2018 | Barnes | |
| 2010/0300498 | A1* | 12/2010 | Wojciechowski, III | B08B 9/0433 134/167 C |
| 2015/0034128 | A1 | 2/2015 | Brumfield | |
| 2017/0321976 | A1* | 11/2017 | Barnes | F28G 15/02 |
| 2020/0132402 | A1 | 4/2020 | Schneider et al. | |
| 2020/0191507 | A1 | 6/2020 | Verstraeten | |
| 2020/0263941 | A1 | 8/2020 | Schneider et al. | |

OTHER PUBLICATIONS

International Search Report and Written Opinion for Application No. PCT/US22/38098 dated Jan. 3, 2023 (12 pages).

* cited by examiner

*Primary Examiner* — Kaj K Olsen
*Assistant Examiner* — Pradhuman Parihar
(74) *Attorney, Agent, or Firm* — Sand, Sebolt & Wernow Co., LPA

(57) ABSTRACT

An apparatus for driving a flexible lance hose into and out of tubes in a heat exchanger tube sheet includes a housing and an upper endless belt drive assembly and a lower endless belt drive assembly spaced apart by a gap for receiving a flexible lance hose therein. One of the drive assemblies is fixed to the housing. The other drive assembly is movable within the housing toward and away from the one endless belt drive assembly. The apparatus further includes a drive motor fastened to the housing configured to engage at least one of the upper and lower endless belts and drive a flexible lance hose disposed in the gap.

16 Claims, 7 Drawing Sheets

DUAL ENDLESS BELT FLEXIBLE LANCE HOSE DRIVE APPARATUS AND SYSTEM

CROSS REFERENCED TO RELATED APPLICATIONS

This application claims the benefit of priority of U.S. Provisional Patent Application Ser. No. 63/225,125 filed Jul. 23, 2021, having the above title.

BACKGROUND OF THE DISCLOSURE

Lance hose drive apparatuses are well known. A dual hose drive apparatus is described in our U.S. Pat. No. 9,630,801. A triple hose drive apparatus is described in our U.S. Pat. No. 9,896,299. Each of these drives simultaneously drive one or more lances. In small heat exchangers, especially those with small diameter tubes, there is a need for a single lance tractor apparatus and system that can be versatilely mounted either to the heat exchanger flange or via a spider support directly to the tube sheet within a dome end structure of the heat exchanger. In cleaning tubes in such heat exchanger, flexible lance slippage may be a significant issue. This in turn can result in premature wear of the drive belts and rollers, as well as the lance hose. There is a need therefore for a drive apparatus that can selectively drive a lance with increased force, without undue wear and which can be deployed within confined spaces.

DETAILED DESCRIPTION

Figure 1:
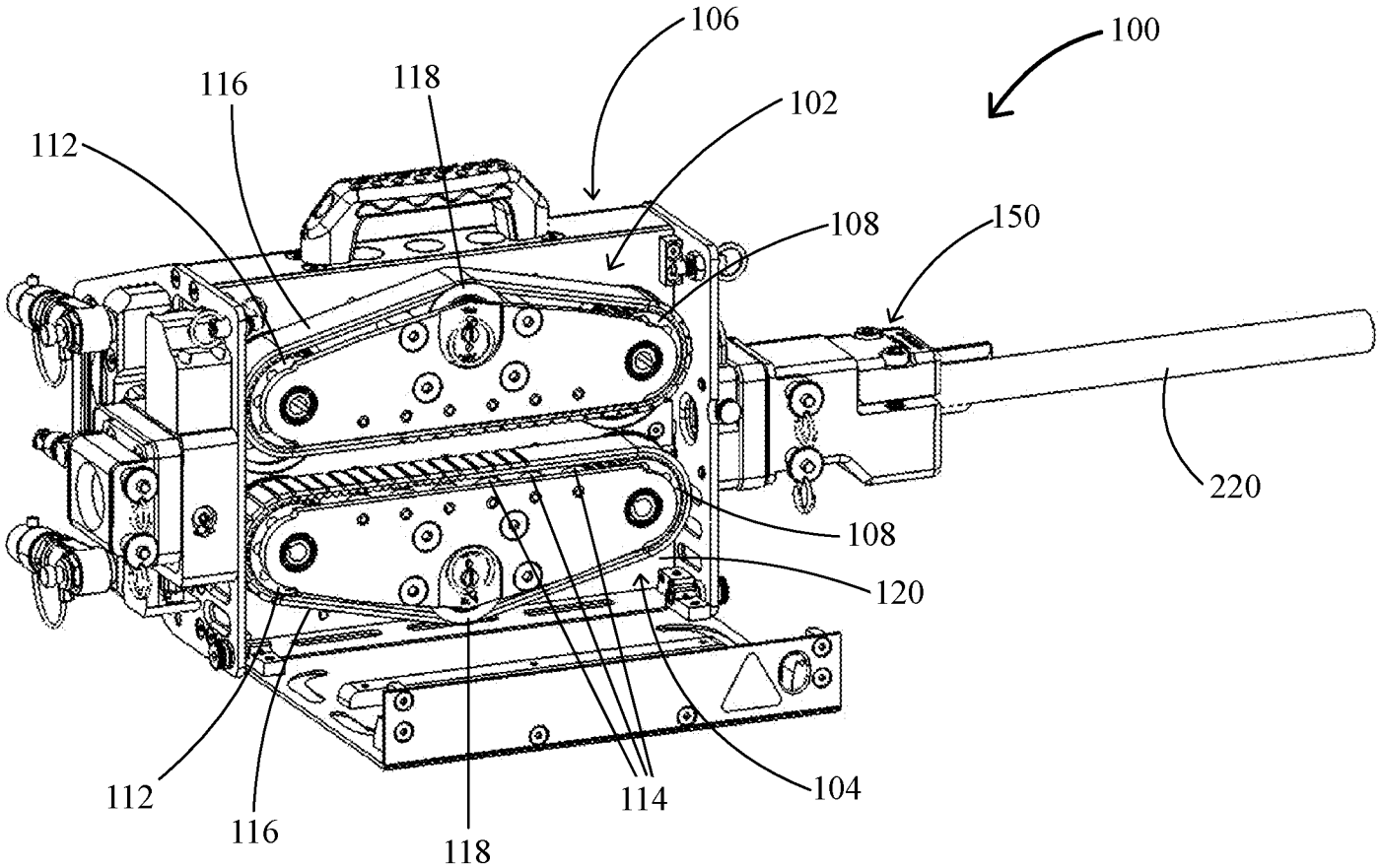
FIG. 1 is a perspective view of a single lance drive apparatus in accordance with the present disclosure shown with a belt side cover open.
Figure 2:
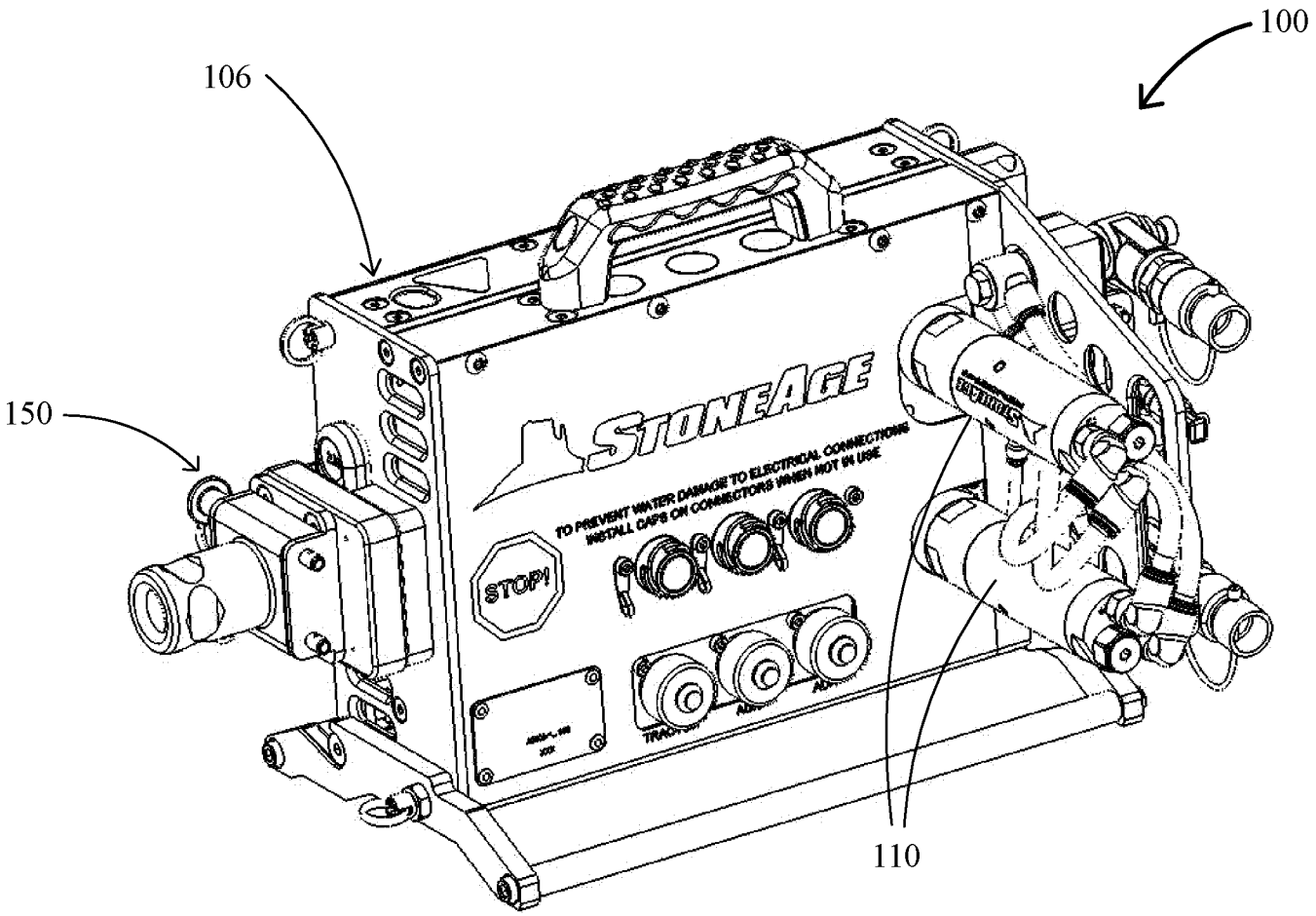
FIG. 2 is a perspective opposite side perspective view of the single lance drive apparatus shown in FIG. 1.

An exemplary right side perspective view of a hose drive apparatus 100 in accordance with the present disclosure for driving a single high pressure fluid lance hose (not shown) is shown in FIG. 1. An opposite side perspective view of the apparatus 100 is shown in FIG. 2. This lance drive apparatus 100 has dual endless belt drive assemblies 102 and 104 carried within a housing 106. Each of the drive assemblies 102 and 104 has a drive sprocket 112 driven by an air motor 110 and a toothed follower sprocket 108 spaced from the drive sprocket 112 by a series of six guide wheels 114 tangent to a plane between the drive sprocket 112 and follower sprocket 108. Each of the drive assemblies 102 and 104 includes an endless belt 116 wrapped around the sprockets 108, 112, the guide wheels 114 and a tension wheel 118 opposite the guide wheels 114.

The lower drive assembly 104 is rigidly fastened to a vertical wall 120 within the housing 106 in the embodiment shown in FIGS. 1-4. The upper drive assembly 102 is separately fastened within the housing 106 to a movable carriage 126 having a carriage support plate 122. The movable carriage support plate 122 has mounted thereto a drive sprocket 112, a follower sprocket 108, and six guide wheels 114 each tangent to the plane between the drive sprocket 112 and follower sprocket 108. A second endless belt 116 is wrapped around the sprockets 108, 112, guide wheels 114 and a tension wheel 118 opposite the guide wheels 114 as in the lower drive assembly 102.

Each endless belt 116 has a roughened or cross grooved outer surface and an opposite inner splined surface to match the splines on the drive sprockets 112 and follower sprockets 108. The guide rollers 114 and tension rollers 118 in each assembly need not be splined and are preferably smooth. The exterior surface of the guide rollers 114 may be flat or may be slightly concave so as to assist in alignment of the flexible lance hose being driven through the drive 100.

This movable support carriage plate 122 is supported by two elongated slotted supports 124 that are fixed to the vertical wall 120 in the housing 10 in a parallel relation. The movable support plate 122 is fastened to the carriage 126 by 4 wheels 128 that each ride in one slot or channel 130 in each of the supports 124. A set of three clamp cylinders 132 are fastened between a top plate 134 of the housing 106 and the carriage 126. These clamp cylinders 132 each carry a piston fastened to the carriage 126. Air pressure within the clamp cylinders 132 cause the carriage 126 to move the support plate 122 up and down within the slots 130 thereby pressing the upper endless belt assembly 104 toward the lower endless belt assembly 102 to capture and grip a flexible lance hose (not shown) between the assemblies 102 and 104. Each of the three clamp cylinders 132 includes a coil spring around the piston such that release of air pressure from the cylinder 132 causes the piston to retract, thus lifting the carriage 126 and thus the entire assembly 102 away from the fixed endless belt drive assembly 104 in the housing 106 so that a lance hose fed into and through the housing 106 can be installed or withdrawn.

Figure 3:
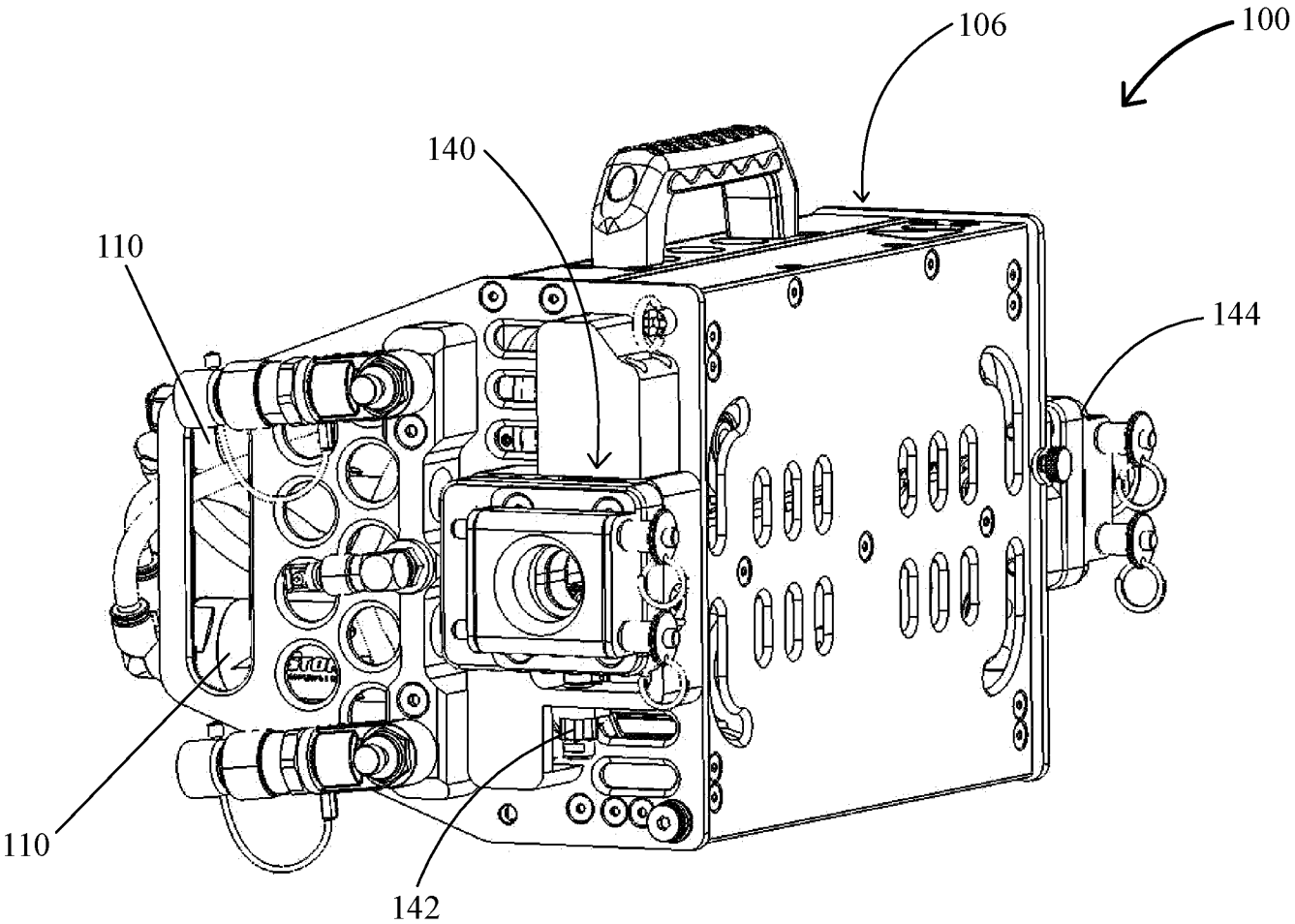
FIG. 3 is a rear perspective view of the apparatus shown in FIG. 1 with the belt side cover closed.
Figure 4:
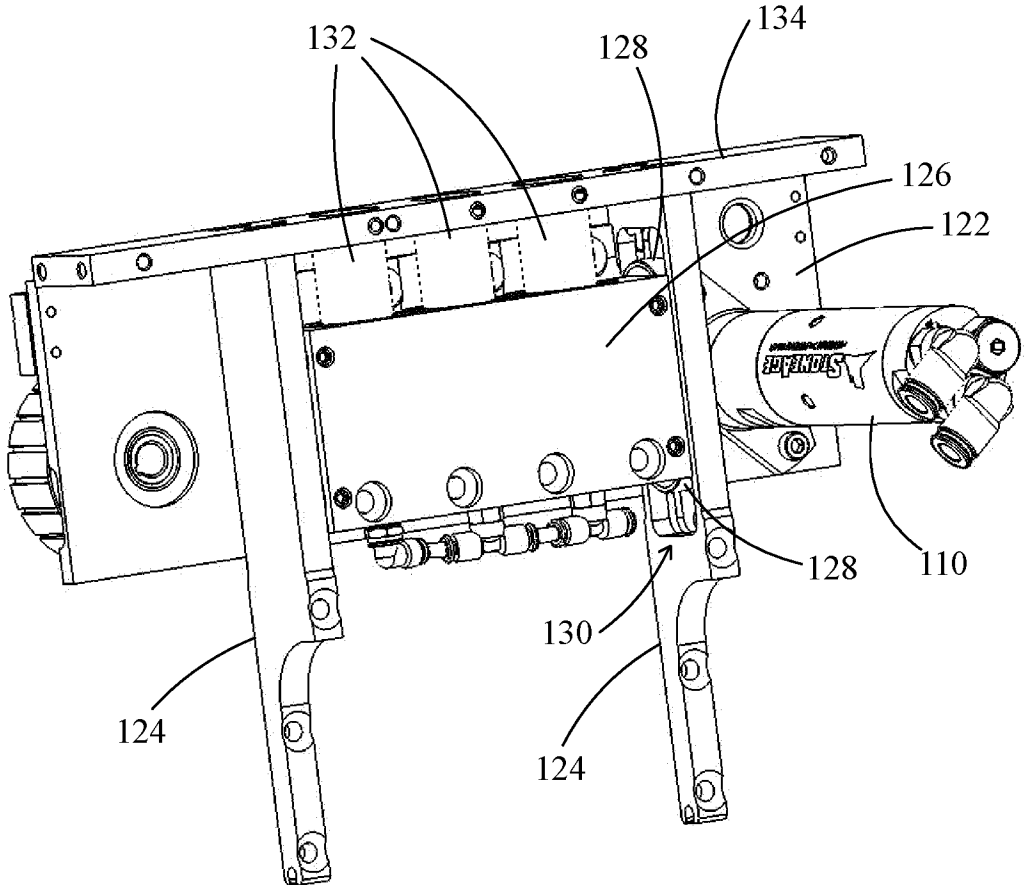
FIG. 4 is a perspective view of the upper endless belt assembly of the apparatus shown in FIG. 1.

A perspective rear end view of the drive 100 is shown in FIG. 3. The upper and lower air motors 110 are visible on the left side. A flexible lance hose (not shown) would be inserted through a stop sensor housing 140 which is fastened to the rear of the housing 106. This stop sensor housing 140 carries a removable stop sensor module which detects the presence or absence of a stopper clamp or "football" clamped to the flexible lance hose at a position on the hose indicative of full insertion of the flexible lance hose in the heat exchanger being cleaned. Mounted between the stop sensor housing 140 and the housing 106 is a lance position sensor 142. The lance position sensor 142 carries a knurled wheel and a spring-loaded bias roller between which the lance hose is fed. As the lance hose passes into and through the housing 106 preferably a Rheintacho gear tooth sensor fastened to the knurled wheel counts the gear teeth and hence tracks the position of the lance hose and sends the position signal to a drive controller.

Figure 5:
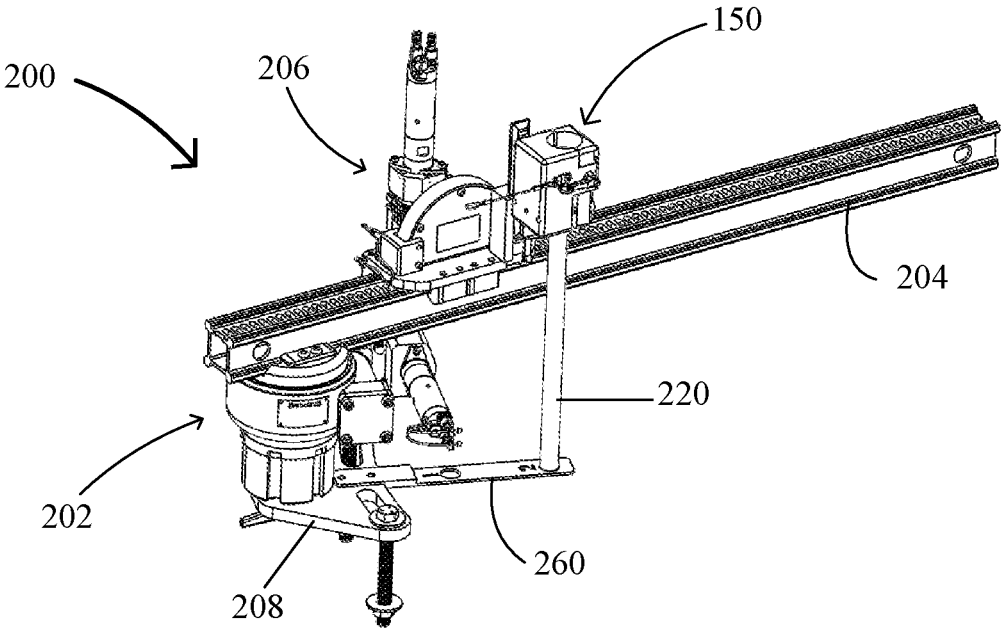
FIG. 5 is a perspective view of the rotary lance drive positioner apparatus for the lance drive shown in FIG. 1 configured for fastening to a heat exchanger flange.

The lance drive 100 shown in FIGS. 1-4 is configured to be fastened by its front-end connection 144 to a tractor guide tube collet block assembly 150 of a lance drive positioner such as that shown in US patent application publication 2020/0263941. One such positioner apparatus 200 is shown in FIG. 5. This assembly 200 includes a rotary drive 202 which rotates an arm 204 about a vertical axis through the rotary drive 202. A linear motor assembly 206 mounted on the arm 204 drives the collet block assembly 150 back and forth along the arm 204, providing a polar coordinate indexing system for a lance carried by the tractor drive 100.

Figure 6:
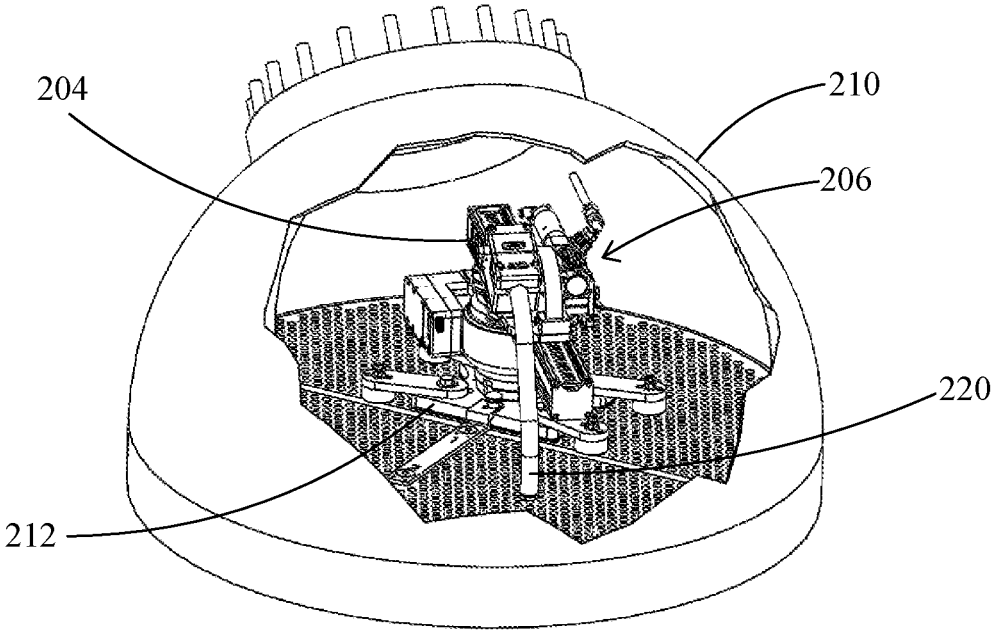
FIG. 6 is a perspective view of a rotary lance drive positioner apparatus for the drive shown in FIG. 1 installed within a heat exchanger end dome.

FIG. 5 shows a configuration where the apparatus 200 is configured to be fastened to a heat exchanger flange via a mounting bracket 208. FIG. 6 shows an alternative configuration in which the positioning apparatus 200 is mounted directly to tubes in the tube sheet within a heat exchanger end dome 210 via a spider mounting bracket 212.

Figure 7:
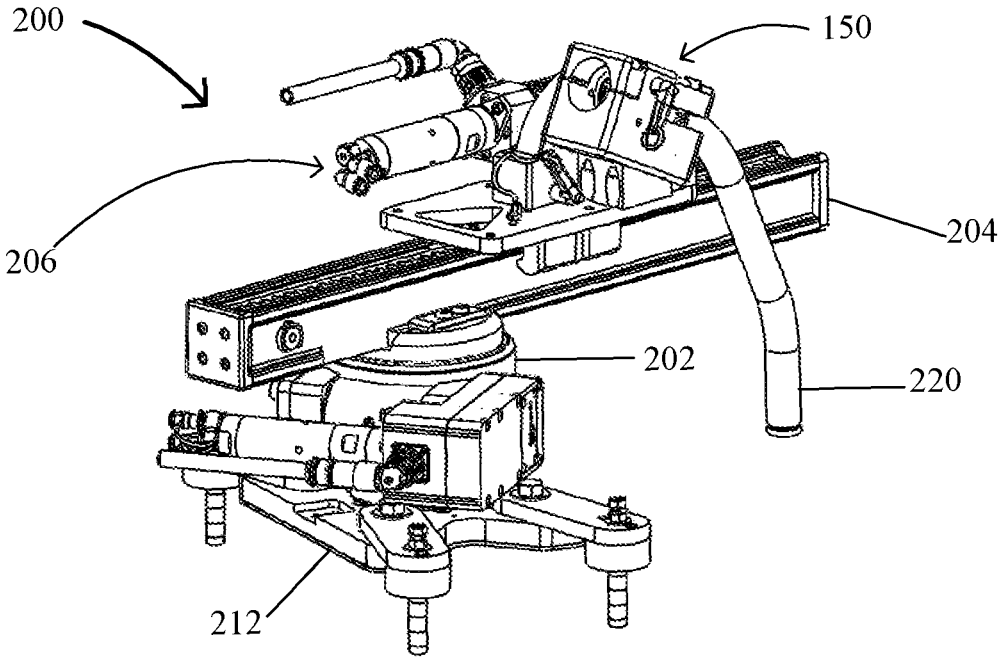
FIG. 7 is an enlarged perspective view of the positioner apparatus shown in FIG. 5 separate from the dome shown in FIG. 5.
Figure 8:
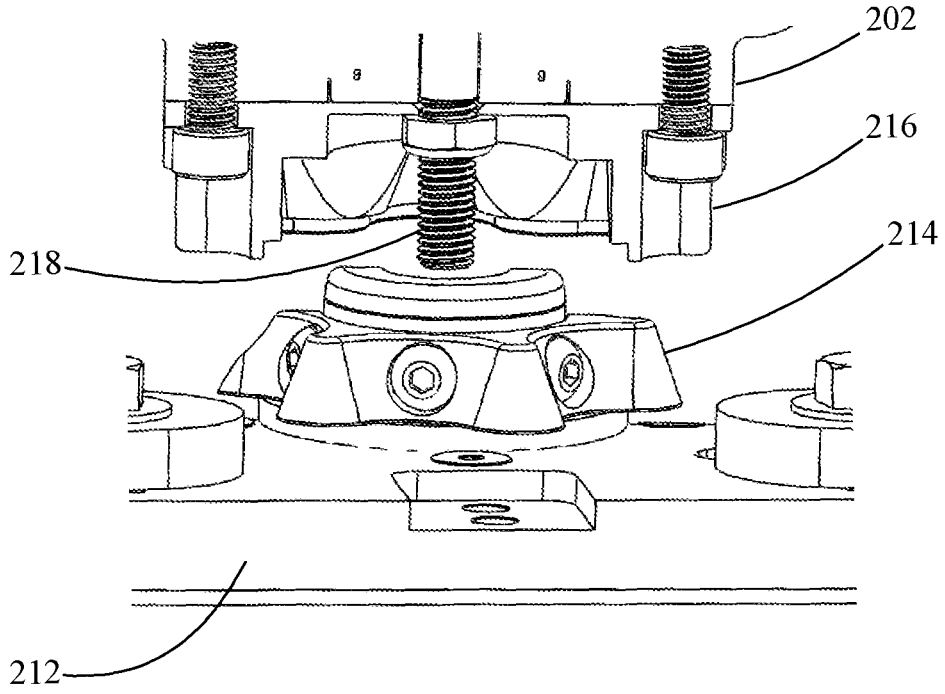
FIG. 8 is an enlarged partial exploded view of the rotary drive connection to the spider shown in FIG. 7.

An enlarged view of apparatus 200 mounted to a spider mounting bracket 212 is shown in FIG. 7. This configuration is slightly different from that shown in Applicant's published application No. 2020/0263941. Instead of using a stub tube with a plurality of arcuately spaced holes and securing the hollow bottom collar of the rotary drive to the stub tube with a lock pin, this new spider mounting bracket 212 utilizes a tapered gear pin 214 and complementary tapered gear socket configuration 216 on the base of the rotary drive 202. A further enlarged partial perspective view of this connection is shown in FIG. 8. A central bolt 218 through the tapered gear 214 and mating socket 216 precisely positions the rotary drive 202 to the center of rotation and to spider mounting bracket 212. This eliminates any backlash movement of the rotary drive 202 housing with respect to the spider mounting bracket 212. Additionally, the linear motor assembly 206 is mounted with its elongated dimension parallel to the arm 204, which reduces the form factor of the apparatus 200, rendering it more suitable for use in confined spaces, such as in the heat exchanger end dome 210.

Figure 9:
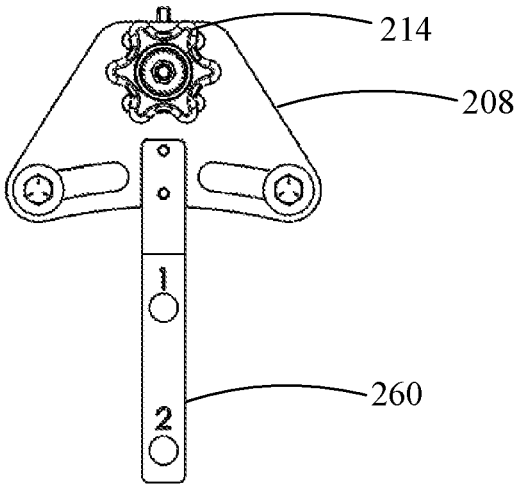
FIG. 9 is a separate plan view of an alignment tool for the flange mount of the positioner apparatus shown in FIG. 6.
Figure 10:
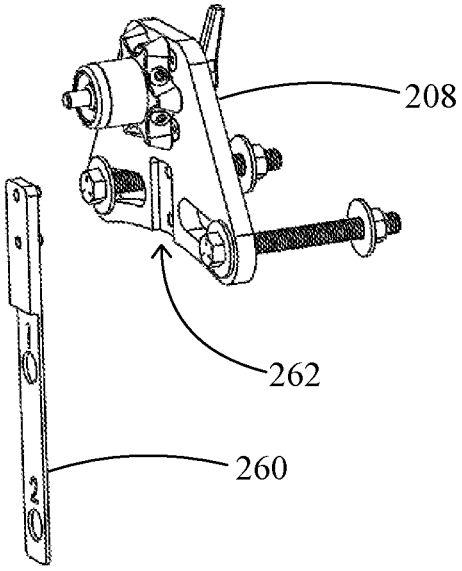
FIG. 10 is a perspective view of the alignment tool shown in FIG. 9.

A further refinement of the apparatus 200 is shown in FIG. 5. Attached to the bracket 208 that is fastened to the heat exchanger flange (not shown) is a special removable alignment tool 260 in accordance with the present disclosure. Use of this tool 260 to align all of the components of the apparatus 200 with only two measurements provides simple and precise polar coordinate alignment of the overall apparatus 200 during use. This tool 260 is separately shown in a plan view in FIG. 9 attached to the flange bracket 208. It is to be understood, however that this tool 260 can be likewise mounted to the spider mounting bracket 212 with the same effect. The alignment tool 260 consists of an elongated bar 260 that is fastened into a slot 262 (shown in FIG. 10) machined in the bracket 208 (or spider mounting bracket 212) preferably so as to extend in a radial direction, about a foot, across the tube sheet (not shown). The elongated bar 260 has a first hole and a second hole spaced a precise distance apart and a precise distance from the centerline of the axis through the tapered gear 214 when the elongated bar is fastened within the machined slot 262. For example, the two holes may correspond to a spacing between two predetermined tube penetrations in the heat exchanger tube sheet, although this is not required. What is required, however, is that when mounted to the bracket 208 or spider mounting bracket 212, the tool 260 distances to the holes 1 and 2 from the axis of rotation are precisely known.

Referring back now to FIGS. 6 and 7, the coupling 150 on the positioning assembly 200 to which the drive 100 is fastened, may include a curved lance guide tube 220. For calibration of the positioner assembly 200, the elongated bar 260 is fastened to the support bracket as shown in FIG. 5 and then the operator navigates the rotary and linear drive to place the end of the guide tube 220 directly over the hole #1. This position is noted to the controller as alignment position 1. The rotary and linear drive 202 and 206 are then repositioned at hole #2. This position is then noted to the controller as alignment position 2. Since these two positions are precisely physically known, this allows the control software to simply and precisely determine any unknown mechanical offsets of the entire polar coordinate system. Furthermore, since the guide tube may be angled, curved or straight, or bent or rotated, this method of calibration using a known calibration stick position is more accurate, providing calibration relative to the actual end position of the guide tube rather than some kind of theoretical offset.

Many changes may be made to the apparatus described above. For example, the housing 106 may be enlarged and a parallel set of fixed and movable dual endless belt drive assemblies 102 and 104 mounted side by side within the housing 106. In such a modification, a different set of drive air motors 110 may be provided opposite the motors shown in FIGS. 1 and 2 or the same air motors 110 could be used to drive both trains.

All such changes, alternatives and equivalents in accordance with the features and benefits described herein, are within the scope of the present disclosure. Such changes and alternatives may be introduced without departing from the spirit and broad scope of my invention as defined by the claims below and their equivalents.

What is claimed is:

1. An apparatus for driving a flexible lance hose into and out of apertures of tubes in a heat exchanger tube sheet, the apparatus comprising:

a housing adapted to be removably positioned on or adjacent to a tube sheet in alignment with tubes penetrating through the tube sheet;

an upper endless belt drive assembly and a lower endless belt drive assembly within the housing spaced apart by a gap for receiving a flexible lance hose therein, wherein one of the upper endless belt drive assembly and the lower endless belt drive assembly is movable relative to the other of the upper endless belt drive assembly and the lower endless belt drive assembly so as to press against the flexible lance hose passing through the gap;

a movable support carriage plate supported by at least one elongated slotted support affixed to a vertical wall in the housing, wherein one of the upper endless belt drive assembly and the lower endless belt drive assembly is connected to the at least one movable support carriage plate and moves up and down therewith; and a drive motor fastened to the housing configured to engage one of the upper and lower endless belts to drive the flexible lance hose disposed in the gap into and out of the apertures of the tubes of the heat exchanger tube sheet.

2. The apparatus according to claim 1, further comprising a second drive motor fastened to a carriage movably supported in the housing carrying the movable one of the upper endless belt drive assembly and lower endless belt drive assembly.

3. The apparatus according to claim 2, wherein the second drive motor is supported independent of the housing.

4. The apparatus according to claim 2, further comprising each of the upper endless belt drive assembly and the lower endless belt drive assembly having an air motor driven spline drive gear, a follower gear and a plurality of guide wheels tangent to a plane between the drive gear and the follower gear.

5. The apparatus according to claim 2, further comprising a biasing member between the housing and the carriage operable to move the movable one of the upper endless belt drive assembly and the lower endless belt drive toward and away from the other endless belt drive assembly.

6. The apparatus according to claim 5, wherein the biasing member includes at least one pneumatic cylinder connected to an interior surface of the housing.

7. The apparatus according to claim 6, wherein the at least one pneumatic cylinder has a piston fastened to the carriage and wherein the carriage is rollably supported between a pair of spaced parallel guides fastened to the housing.

8. The apparatus according to claim 1, wherein the movable support carriage plate is supported by two elongated slotted supports in parallel relation affixed to the vertical wall in the housing.

9. The apparatus according to claim 1, further comprising:

a carriage having wheels that ride in a slot or channel defined in the at least one elongated slotted support, wherein the carriage is connected to the movable support carriage plate.

10. The apparatus according to claim 1, further comprising:

a carriage that rides in a slot or channel defined in the at least one elongated slotted support; and a piston-and-cylinder connected between the carriage and the housing, wherein piston and cylinder move the movable support carriage plate up and down within the slot or channel thereby pressing one of the upper endless belt assembly and the lower endless belt assembly toward the other of the upper endless belt assembly and the lower endless belt assembly to capture and grip a flexible lance hose therebetween.

11. A system for cleaning tubes of a heat exchanger with a flexible lance hose, the system comprising:

an apparatus for driving the flexible lance hose, wherein the apparatus for driving the flexible lance hose includes:

a housing adapted to be removably positioned on or adjacent a tube sheet in alignment with tubes penetrating through the tube sheet;

an upper endless belt drive assembly and a lower endless belt drive assembly within the housing spaced apart by a gap for receiving a flexible lance hose therein, wherein one of the upper endless belt drive assembly and the lower endless belt drive assembly is movable relative to the other of the upper endless belt drive assembly and the lower endless belt drive assembly so as to press against the flexible lance hose passing through the gap;

a drive motor fastened to the housing configured to engage one of the upper and lower endless belts and drive the flexible lance hose disposed in the gap;

a flexible lance positioner apparatus that includes:

a bracket configured to be fixedly mounted relative to the tube sheet, wherein:

the bracket includes a tapered gear pin extending normally from the bracket, and the tapered gear pin has a central axis;

a rotary drive removably fastened to the tapered gear pin by a complementary tapered gear socket, the rotary drive rotatable about the central axis in a plane parallel to the tube sheet;

an arm coupled to the rotary drive and rotatable in the plane parallel to the heat exchanger tube sheet;

a linear drive assembly slidably engaged along the arm; and a guide tube collet block assembly coupled to the linear drive assembly, wherein:

the guide tube collet block assembly removably supports the apparatus for driving the flexible lance hose apparatus, and the guide tube collet block assembly guides the flexible lance hose received from the apparatus for driving the flexible lance hose into a selected one of a plurality of apertures of the tube sheet.

12. The system of claim 11, wherein the apparatus for driving the flexible lance hose further comprises:

a carriage movably supported in the housing carrying the movable one of the upper endless belt drive assembly and lower endless belt drive assembly.

13. The system of claim 12, wherein the apparatus for driving the flexible lance hose further comprises:

a biasing member between the housing and the carriage operable to move the movable one of the upper endless belt drive assembly and the lower endless belt drive toward and away from the other endless belt drive assembly.

14. The system of claim 11, wherein:

the tapered gear pin is fastened with the tapered gear socket by a central bolt passing through the central axis;

the removable alignment tool includes a first alignment hole and a second alignment hole;

the first alignment hole and the second alignment hole are separated by a first known distance; and the first alignment hole and the second alignment hole are each separated from the central axis by a second known distance.

15. The system of claim 11, wherein the lance positioner apparatus further comprises:

a guide tube coupled to the guide tube collet block assembly, wherein the removable alignment tool is configured to calibrate the flexible lance positioner apparatus by alignment of the guide tube to the first alignment hole and then the second alignment hole.

16. The apparatus according to claim 8, further comprising:

a carriage having wheels that ride in each slot or channel defined in the two elongated slotted supports, wherein the carriage is connected to the movable support carriage plate.

* * * * *